US005632178A

United States Patent [19]

Uhlemann et al.

[11] Patent Number: 5,632,178

[45] Date of Patent: May 27, 1997

[54] METHOD AND APPARATUS FOR FORMING A T-SHAPED SLOT IN A SHEET MATERIAL

[76] Inventors: Karl Uhlemann, G2 Nevada Court, Brampton, Ontario, Canada, L4S 4S6; Walter Rudnisky, R.R. #1, Cookstown, Ontario, Canada, J0L 1L8; Peter Chiodo, 5752 Teeswater Road, Malton, Ontario, Canada, L4T 2A4

[21] Appl. No.: 462,373

[22] Filed: Jun. 5, 1995

[51] Int. Cl.[6] ..... B21D 5/16

[52] U.S. Cl. ..... 72/307; 72/312; 72/400; 72/420

[58] Field of Search ..... 72/307, 312–315, 72/400, 398, 397, 420, 428

[56] References Cited

U.S. PATENT DOCUMENTS

| | | | |
|---|---|---|---|
| 404,164 | 5/1889 | Buckman | 72/319 |
| 948,551 | 2/1910 | Rigby | 72/398 |
| 3,768,294 | 10/1973 | Van Dijk | 72/307 |
| 3,838,590 | 10/1974 | Van Dijk | 72/307 |
| 4,091,652 | 5/1978 | Wilcox | 72/400 |
| 4,573,296 | 3/1986 | Wrigley | 72/307 |

*Primary Examiner*—Daniel C. Crane

*Attorney, Agent, or Firm*—Jeffrey T. Imai; D. Doak Horne; Arne I. Fors

[57] ABSTRACT

A method and apparatus is described for forming a T-shaped slot a sheet of material. The sheet of material is clamped to a top surface of an arbor. The arbor has a uniform T-shaped cross section having two undersides of the T-shape. The sheet of material is first formed into an inverted U-shape and then the sheet of material is bent to conform to the undersides of the arbor forming the T-shaped slot. The arbor is withdrawn from an open end of the formed T-shaped slot.

4 Claims, 5 Drawing Sheets

METHOD AND APPARATUS FOR FORMING A T-SHAPED SLOT IN A SHEET MATERIAL

FIELD OF INVENTION

This invention relates to the method and apparatus for forming a T-shaped slot in a sheet material. In particular, this invention relates to method and apparatus for forming a T-shaped slot for receiving a bracket for use in a shelving system.

BACKGROUND OF INVENTION

In the retail industry, shelving is very important and essential for effective marketing. The shelving must be flexible and reusable in order to accommodate the changing trends in retailing practises.

One shelving system uses a wood panel, which has a routed T-shaped slot. Flattened S-shaped brackets may then be inserted into the slot for support thereof. Shelving and other display items are attached to the brackets and then applied to the wood panel in any desired arrangement. Since all of the slots and brackets are uniform, the possibilities in arrangements for shelving and displays are infinite.

An alternative to the wood panel is a sheet metal panel. Sheet metal panels are bent to form the T-shaped slots (see FIG. 1). The sheet metal panel has the advantage of being lighter than wood panels and thus easier to install and arrange. However for each T-shaped slot, four separate bending operations are required to form a single slot. More significantly is that the bending operation prohibits the middle bended section from extending substantially parallel to the front face. The middle bended portion is always at an angle to the front face. The result is that the flattened S-shaped brackets do not properly fit in the T-shaped slot as the bracket is unable to sit flush with the face of the slotted panel causing the bracket to be cantilevered which is undesirable.

One solution has been to decrease the depth of the T-shaped slot. However, this has the disadvantage of having less material at critical stress areas. With less material, the panel is less able to resist bending movements and thus more susceptible to being deformed rendering it unsightly for marketing purposes.

Another solution is to bend the flattened S-shaped brackets to complement the bended middle portion. However, since the angle at which the bended middle portion extends is not uniform, the brackets do not fit snugly in all cases.

SUMMARY OF THE INVENTION

The disadvantages of the prior art may be overcome by providing a method of forming a T-shaped slot in a sheet material using a single process.

It is desirable to provide an apparatus which can form a T-shaped slot in a sheet material in a single process.

It is desirable to provide an apparatus which can produce a plurality of successive T-shaped slots uniformly spaced across the face of the finished panel.

According to one aspect of the invention, a T-shaped slot is formed in a sheet of material. First the sheet of material is clamped to a top surface of an arbor. The arbor has a uniform T-shaped cross section having two undersides of the T-shape. The sheet of material is first formed into an inverted U-shape and then the sheet of material is bent to conform to the undersides of the arbor forming the T-shaped slot. The arbor is withdrawn from an open end of the formed T-shaped slot.

According to another aspect of the invention, there is provided an apparatus for forming a T-shaped slot in a sheet of material. The apparatus has a press bed having a longitudinal and a transverse direction. The apparatus has press head reciprocally mounted above the bed and a first drive for reciprocally moving the head between an open, intermediate and closed position. The apparatus has an arbor slidably mounted on the bed for sliding in a transverse direction. The arbor has a uniform T-shaped cross section and a second drive for effecting the sliding movement of the arbor. The apparatus has a spring mounted retaining block mounted on the head above the arbor for clamping a sheet of material to a top surface of the arbor as the head moves from the intermediate to the closed position. The apparatus has a front die slidably mounted on the head forward of the arbor. The front die is slidable in the longitudinal direction. The front die has a rearward-facing tongue complementary to an underside of the T-shaped cross-section and a third drive for effecting the sliding movement of the front die. The apparatus has a rear die slidably mounted on the head rearwardly of the arbor. The rear die is slidable in the longitudinal direction. The rear die has a forward-facing tongue complementary to the underside of the T-shaped cross-section and a fourth drive for effecting the sliding movement of the rear die. The sheet of material is introduced to the apparatus in the open position, clamped to the top surface of the arbor after the head moves from the open position to the intermediate position. The sheet of material is then bent about the top of the arbor as the head moves from the intermediate to the closed position. The sheet of material is then bent about the underside of the arbor as the front and rear dies move towards the arbor. The arbor is withdrawn from an open end of a formed T-shaped slot.

According to another aspect of the invention, the arbor is in two sections, each slidably mounted on the bed and the second drive has two drivers, each connected to one of the two sections.

DESCRIPTION OF THE DRAWINGS

In drawings which illustrate embodiments of the invention.

DESCRIPTION OF THE INVENTION

Figure 2:
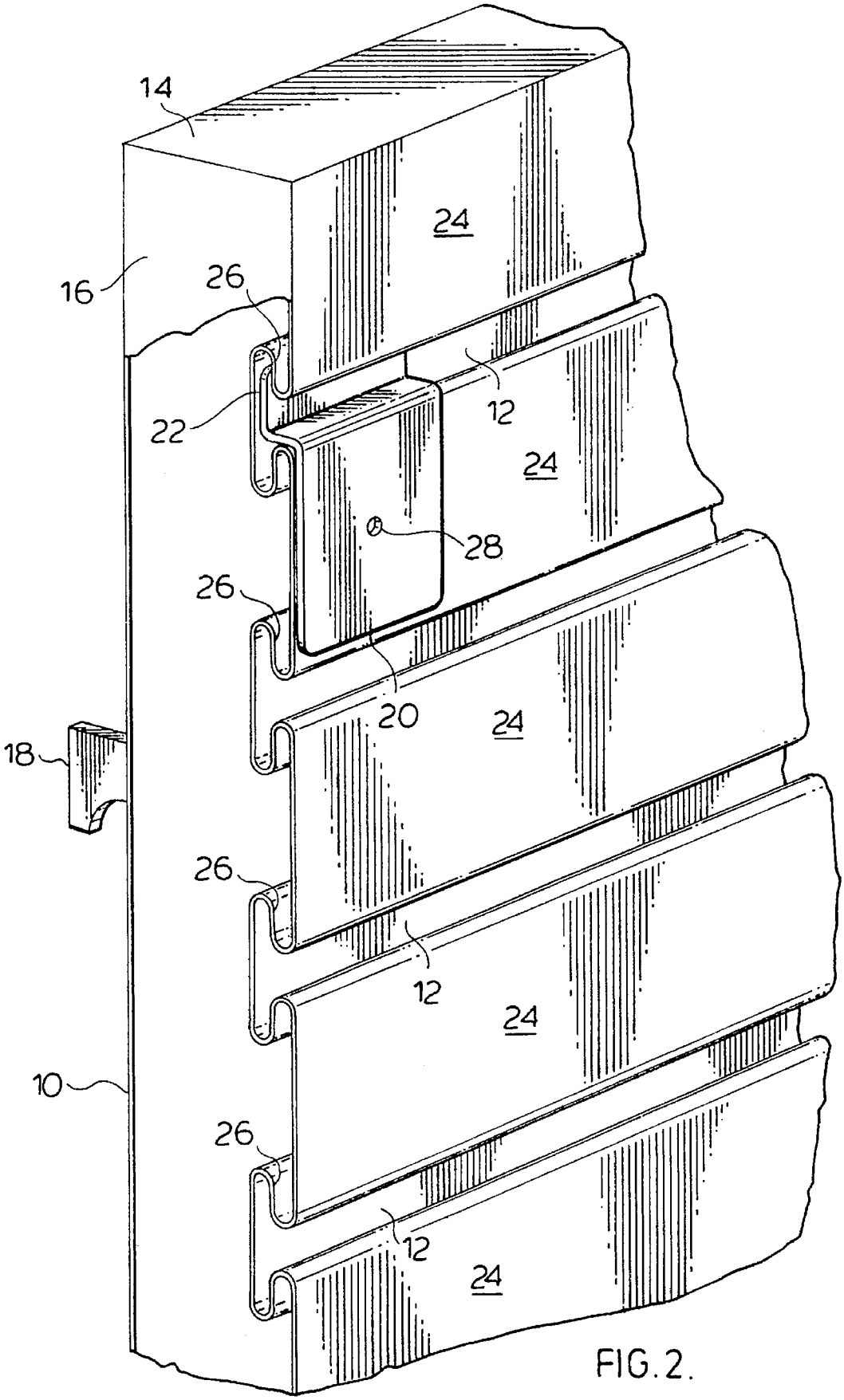
FIG. 2 is a perspective view of a slotted panel formed by the method of the present invention.

Referring to FIG. 2, a shelving panel 10 having the T-shaped slots 12 formed by the method and apparatus of the present invention is illustrated. The panel 10 has a top face 14, rear panel 15, side faces 16 and a bottom face (not illustrated) for closing off the panel. Panel 10 has in plurality of hooks 18 spaced along the side edges of the panel 10 for supporting the panel 10 to a wall surface or a support. Other types of hanging or attachment mechanisms may also be used.

Bracket 20 has a flattened S-shape in side elevation. The tab 22 is sized to be inserted into the T-shaped slot 12 allowing the bracket 20 to be rotated to abut the front face 24 and bended middle face 26 of T-shaped slot 12. In this well known manner, the bracket 20 firmly supports and retains the shelving (not illustrated) which can be mounted onto the bracket through aperture 28 or any other well known method in the art.

Figure 3:
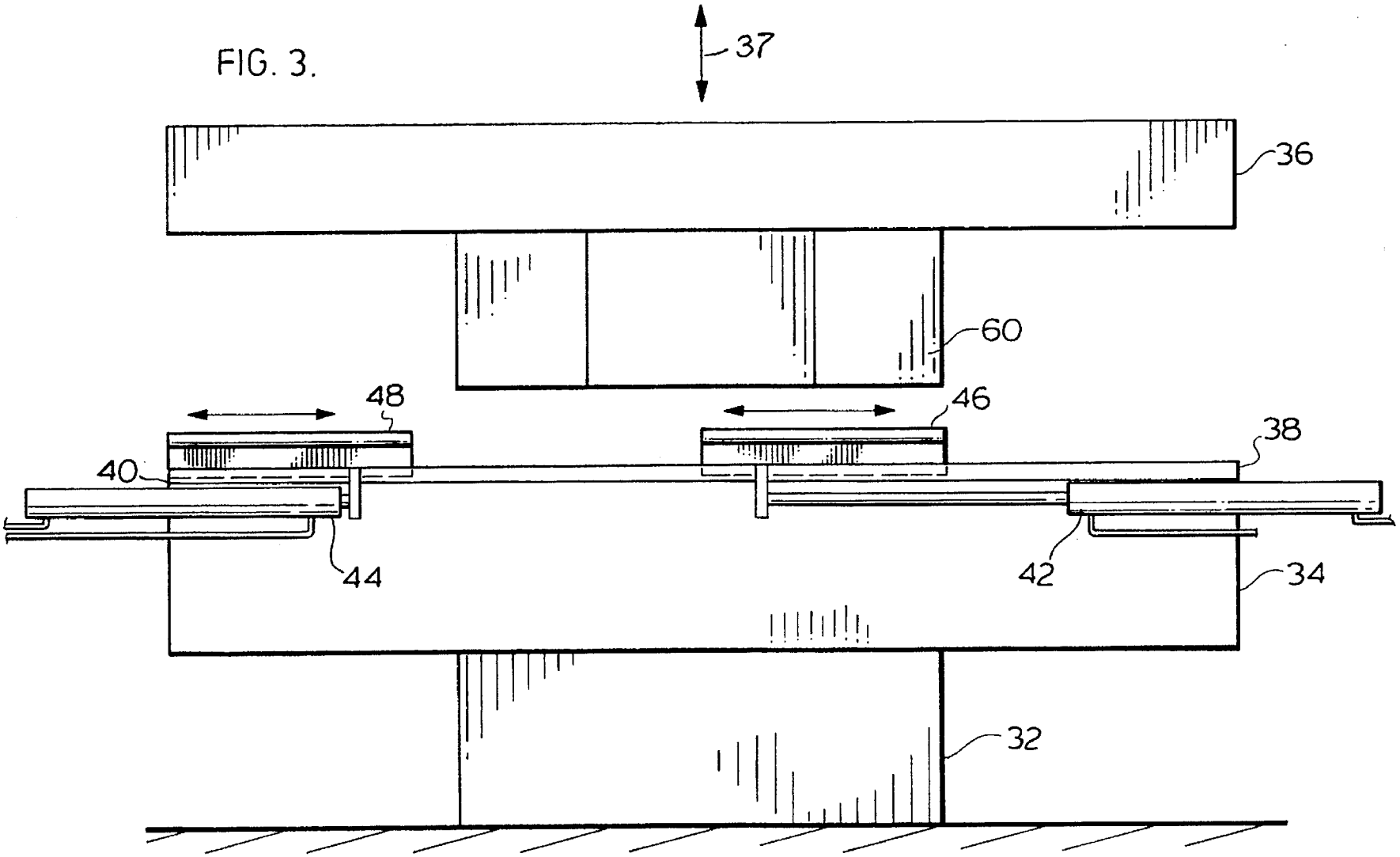
FIG. 3 is a front elevational view, partly in section, of the press for undertaking the method of the present invention.

Referring to FIG. 3, a front elevation of the press 30 for undertaking the method of the present invention is illustrated. The press 30 comprises a base 32, a bed 34, and a head 36. The head 36 is moved by means of a hydraulic cylinder 37 for reciprocally moving the head relative to the base 32 and bed 34.

Mounted on bed 34 are two moveable arbor molds 38 and 40. Internal of each of the arbor molds 38 and 40 is a pneumatic cylinder 42, 44. The pneumatic cylinders are each connected to the arbors 46 and 48, respectively, to effect back and forth or reciprocal movement in a transverse direction relative to the bed 34. The pneumatic cylinders 42 and 44 have standard fittings connected to an air supply. (not illustrated) It can be readily understood that hydraulic cylinders or other similar transport mechanisms may be used in substitution of the pneumatic cylinders 42 and 44.

Figure 4:
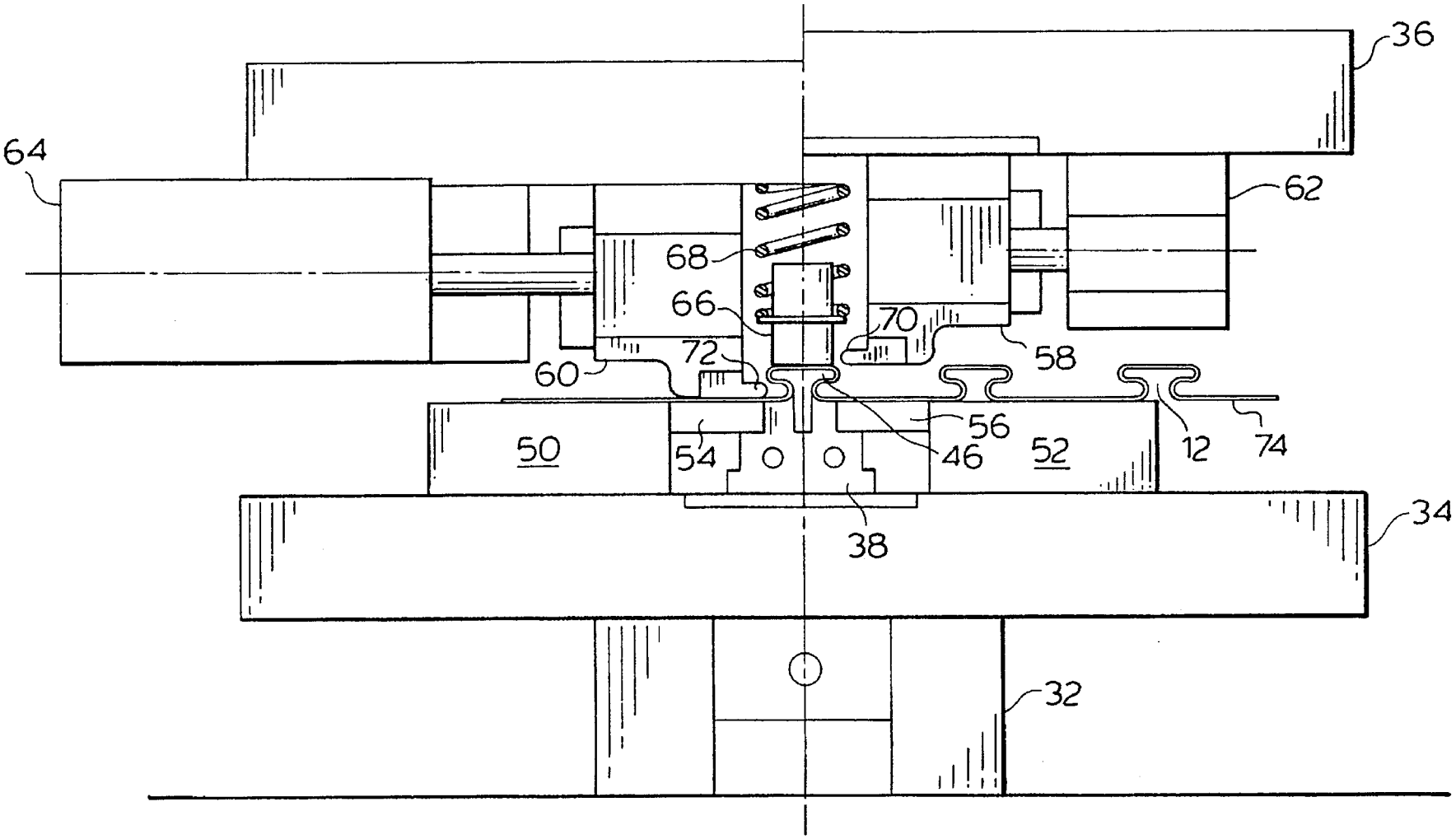
FIG. 4 is a side elevational view, partly in section, of the press for undertaking the method of the present invention.

Referring now to FIG. 4, an end elevation view of the press 30 is illustrated. Forwardly and rearwardly of arbor molds 38 and 40 are platforms 50 and 52 and connecting platforms 54 and 56, respectively. The platforms 50, 52, 54, and 56 present a uniform bending surface relative to the arbors 46 and 48.

As illustrated, arbors 46 and 48 have a uniform T-shaped cross-section complementary to the desired T-shaped slot to be formed. Arbors 46 and 48 have a top surface and two undersides defining the T-shaped cross section.

FIG. 4 illustrates the head 36 of the press 30 being in two different positions on the left and right sides. This is for illustrative purposes only.

Mounted on the head 36 is rear die 58 and front die 60. Dies 58 and 60 are slidably mounted for reciprocally sliding in a front-to-back or longitudinal direction relative to the bed 34. Also mounted on the head 36 are hydraulic cylinders 62 and 64. Hydraulic cylinders are connected to the rear and front dies, 58 and 60, respectively, for effecting the front-to-back or longitudinal motion thereof.

Mounted intermediate of the dies 58 and 60 is a retaining block 66 mounted on a vertical spring 68. Retaining block 66 has a transverse length substantially equal to the combined length of arbors 46 and 48, and a front-to-back or longitudinal depth of approximately the front-to-back depth of the top surface of the arbors 46, 48.

Each die has a tongue 70, 72. Tongues 70, 72 are complementary to the undersides of the arbors 46 and 48 and bending surface of platforms 50, 52, 54 and 56. Tongue 70 is rearward-facing and tongue 72 is forward-facing.

Figure 5:
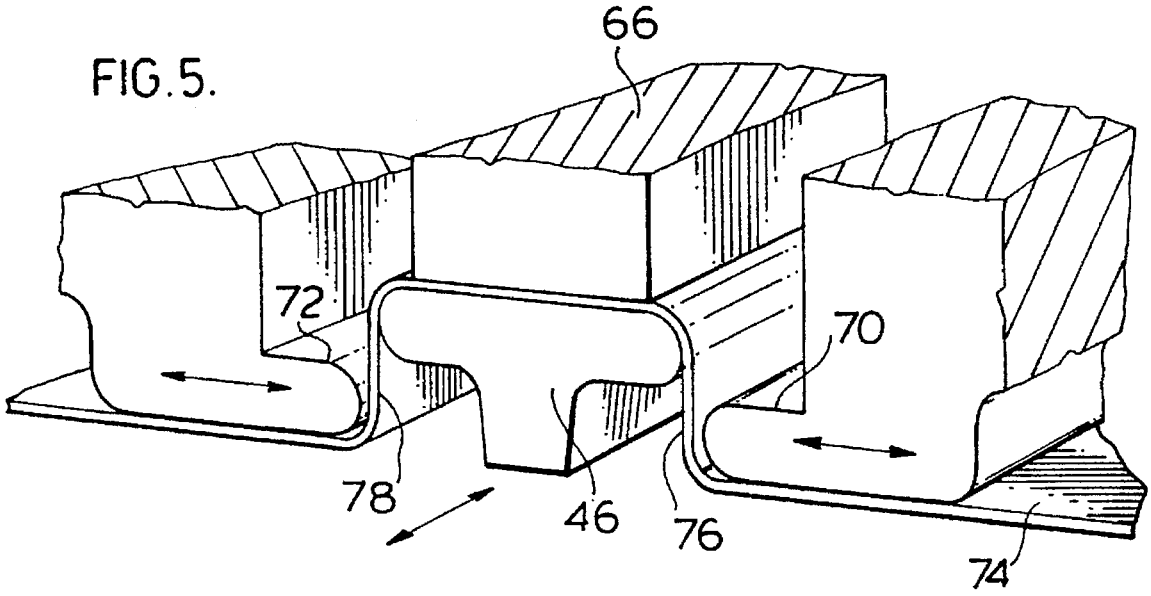
FIG. 5 is an end perspective view of the T-shaped slots being formed by the present invention.

Referring now to FIGS. 3, 4, and 5, the method of the present invention will now be described in greater detail. The pneumatic cylinders 42 and 44 are activated to move the arbors 46 and 48 inwardly towards each other until each abuts with the other presenting a single transversely extending arbour. A sheet of metal 74 is moved between the bed 34 and head 36 of the press when in an open position. The press 30 is then closed to an intermediate position, firmly clamping the sheet of metal 74 between the retaining block 66 and arbour 46, 48, as illustrated in the right side of FIG. 4. Since retaining block 66 is spring-mounted, further movement of the head 36 towards the bed 34 will allow relative motion between the retaining block 66 and the dies 58, 60.

Referring to FIG. 5, the head 36 is advanced until the dies 58, 60 abut with the bending surface of connecting platform 54 and 56. This relative motion will form an upside down U-shape in the sheet metal 74. Once a predetermined amount of pressure has been exerted on the sheet of metal 74, hydraulic cylinders 62 and 64 are activated causing the dies 58 and 60 to move inwardly relative to the arbors 46 and 48. Tongues 70 and 72 will then urge the arms 76, 78 of the U-shape inwardly until the sheet of metal 74 conforms to the undersides of the arbors 46, 48 and the bending surface of platforms 54, 56, 58 and 60.

After a predetermined amount of pressure has been applied, the hydraulic cylinders 62 and 64 retract, the head 36 is then retracted to its rest position. At the same time that the head 36 is returning to its rest position, the pneumatic cylinders 42 and 44 are activated causing arbors 46 and 48 to slide transversely relative to the bed 34 until the now bended sheet of material 74 having the newly formed T-shaped slot, is freed from the arbour 46 and 48. Sheet 74 may be moved longitudinally along in order to form the next adjacent T-shaped slot 12 in sheet 74.

In the preferred embodiment, arbors 46 and 48 are in two sections. It is apparent that arbors 46 and 48 could also be made in a single section. However, the time required to remove the single arbor is increased, increasing the cycle time of production.

Figure 1:
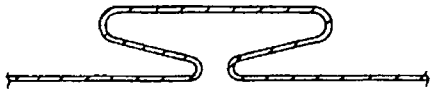
FIG.1. (Prior Art)
FIG. 1 is an end elevational view of a T-shaped slot of the prior art.
Figure 7:
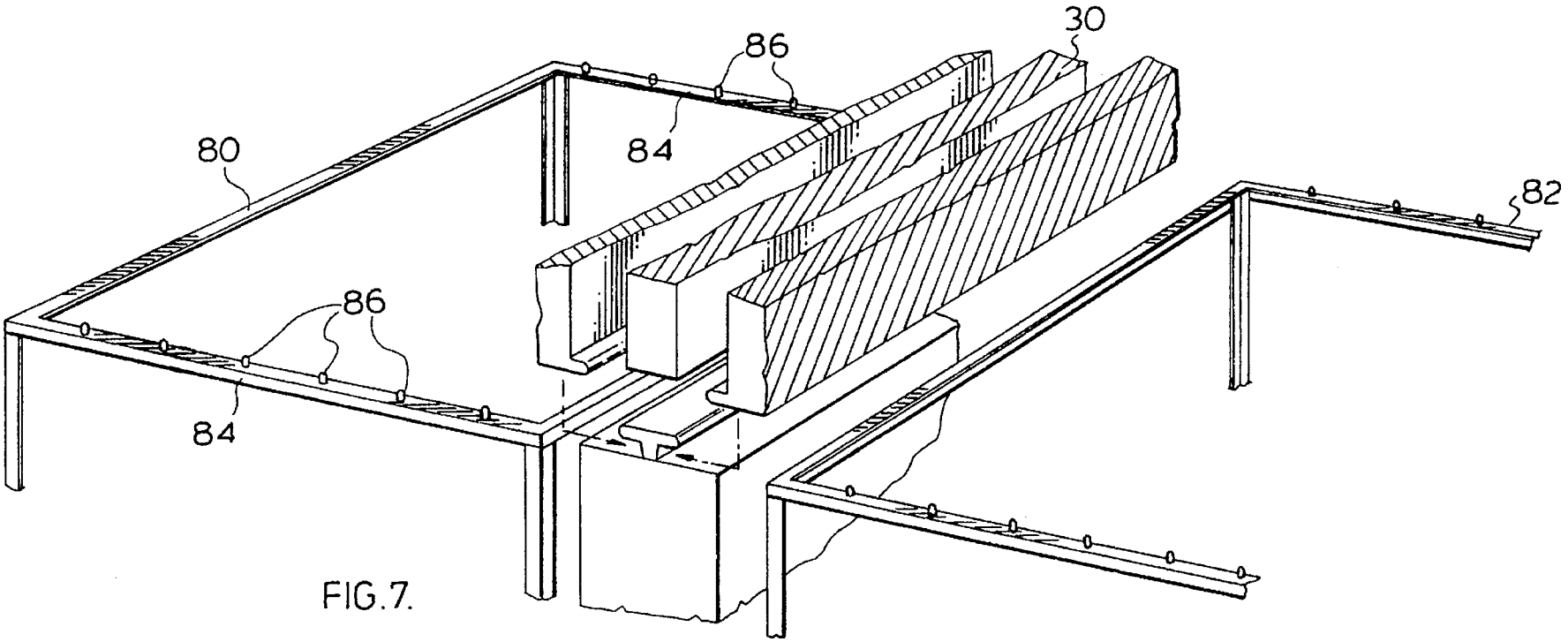
FIG. 7 is a perspective view of the guide assembly and press for the present invention.
Figure 6:
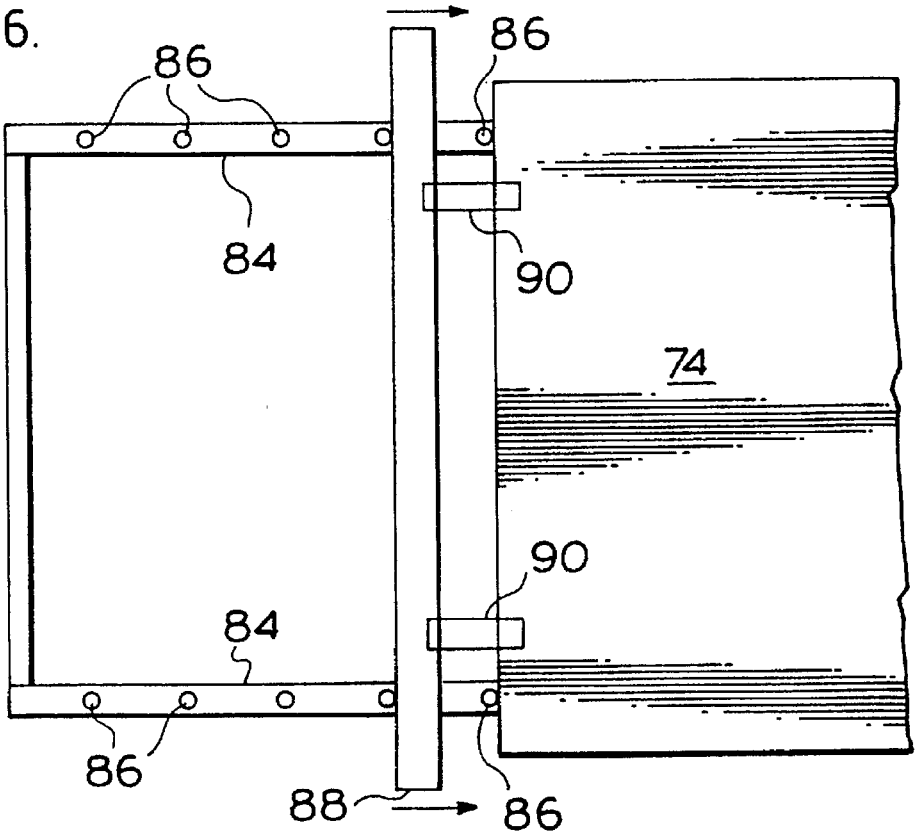
FIG. 6 is a top plan view of a sheet material being held by a guide assembly for spacing the T-shaped slots being formed by the present invention.

Referring now to FIGS. 6 and 7, a method of spacing in the T-shaped slots 12 is illustrated. Mounted in front of the press 30 is a stand 80. Stand 80 has a frame comprising two longitudinal connectors 84 which have upwardly extending pins 86. Pins 86 are spaced along connectors 84.

Sheet 74 is clamped to guide 88 by clamps 90, which are conventional clamps. Clamps 90 connect to the transverse edge of sheet of metal 74 such that guide 88 extends substantially parallel to the transverse edge. The guide 88 has a length greater than the transverse width between longitudinal connectors 84.

Rearwardly of the press 30 is a stand 82. Stand 82 can be any standard construction suitable for supporting sheet of meal 74 substantially co-planar with the bending surface of platforms 50, 52, 54 and 56.

The operator positions the sheet of material 74 in the press by abutting guide 88 with the first set of pins 86. The press is then operated forming the first T-shaped slot 12 in the sheet of metal 74. Once completed, the user lifts the guide 88 over the first set of pins until it abuts with the second set of pins. Once abutting, the press is again initiated forming a second T-shaped slot 12 in the sheet of metal 74. The process is repeated until the desired number of T-shaped slots have been formed in the sheet of metal 74.

The guide assembly, as described, allows the proper positioning of the sheet of metal for the formation of the T-shaped slot. More importantly though, since the guide 88 is not affixed to the guide assembly, guide 88 is allowed to slide back towards the press as the undersides of the T-shaped slot is being formed which allows movement of the ends of the sheet of metal 74. This movement prevents substantial thinning of the metal as it bends about the arbors 46, 48.

As can be seen in FIGS. 2 and 4, the bended middle face 26 of T-shaped slot 12 formed by the method and apparatus of the present invention is substantially parallel to the face of the panel 24.

It is now apparent to a person skilled in the art that the method and apparatus of the present invention could be readily modified. It is understood that certain changes in style, size, and components may be effected without departure from the spirit of the invention and within the scope of the intended claims.

We claim:

1. A method of forming a series of uniform T-shaped slots in a sheet of material comprising the steps of attaching a guide assembly along an edge of a sheet of material, positioning said guide assembly with one of a set of positioning pins, clamping said sheet of material to a top surface of an arbor having a uniform T-shaped cross section having two undersides of a T-shape, bending said sheet of material about the arbor forming a T-shaped slot by forming an inverted U-shape in said sheet of material and then conforming said sheet of material to said undersides drawing ends of said sheet material, withdrawing said arbor from an open end of said T-shaped slot, releasing said sheet material, advancing said guide assembly to a next one of said positioning pins, and repeating said clamping, bending, withdrawing and releasing steps.

2. A method as claimed in claim 1 wherein said arbor comprises two pieces and each of said pieces is withdrawn from opposite open ends of said T-shaped slot.

3. An apparatus for forming a series of uniform T-shaped slots in a sheet of material, said apparatus comprising a press bed having a longitudinal and a transverse direction, a press head reciprocally mounted above said bed, a first drive means for reciprocally moving said head between an open, intermediate and closed position, an arbor slidably mounted on said bed for sliding in a transverse direction, said arbor having a top surface, from underside and rear underside defining a uniform T-shaped cross section, a second drive means for effecting said sliding movement of said arbor, a spring mounted retaining block mounted on said head above said arbor for clamping a sheet of material to said top surface as said head moves from the intermediate to the closed position, a front die slidably mounted on said head forward of said arbor, said front die slidable in the longitudinal direction, said front die having a rearward-facing tongue complementary to the front underside of said T-shaped cross-section, a third drive means for effecting said sliding movement of said front die, a rear die slidably mounted on said head rearwardly of said arbor, said rear die slidable in the longitudinal direction, said rear die having a forward-facing tongue complementary to said rear underside of said T-shaped cross-section, a fourth drive means for effecting said sliding movement of said rear die, a guide assembly for attachment to an edge of the sheet of material, a stand positioned along a transverse edge of said bed, said stand having a set of spaced upwardly extending pins for positioning said sheet of material, whereby said sheet of material is introduced to the apparatus in said open position, positioned with the guide assembly against one of said set of upwardly extending pins and then clamped to the top surface of the arbor after said head moves from the open position to the intermediate position and then bent over said arbor as the said head moves from the intermediate to the closed position and then bent about the arbor as the front and rear dies move towards said arbor drawing ends of said sheet material, said arbor is withdrawn from an open end of a formed T-shaped slot and said sheet material is released and the guide assembly is advanced to a next one of said positioning pins for forming an adjacent T-shaped slot.

4. An apparatus as claimed in claim 3 wherein said arbor is in two sections, each slidably mounted on said bed and said second drive means has two drives each connected to one of said two sections.

* * * * *